US006595133B2

(12) United States Patent
Königer

(10) Patent No.: US 6,595,133 B2
(45) Date of Patent: Jul. 22, 2003

(54) DEVICE FOR INTERNAL MASS BALANCING IN SELF-RECIPROCATING ROLLS

(75) Inventor: Johann Königer, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/740,308

(22) Filed: Dec. 18, 2000

(65) Prior Publication Data

US 2001/0022144 A1 Sep. 20, 2001

(30) Foreign Application Priority Data

Dec. 16, 1999 (DE) ..... 199 60 698

(51) Int. Cl.[7] ..... B41F 31/00; B41F 5/00; B41L 27/16

(52) U.S. Cl. ..... 101/350.3; 101/216; 101/348

(58) Field of Search ..... 101/350.03, 348, 101/216, DIG. 38

(56) References Cited

U.S. PATENT DOCUMENTS 5,429,050 A 7/1995 Palmcrantz

FOREIGN PATENT DOCUMENTS

| | | |
|---|---|---|
| DE | 30 11 384 | 10/1981 |
| DE | 44 30 625 | 3/1995 |
| DE | 42 33 460 | 11/1995 |
| GB | 2 073 368 | 10/1981 |

*Primary Examiner*—Andrew H. Hirshfeld
*Assistant Examiner*—Marvin P. Crenshaw
(74) *Attorney, Agent, or Firm*—Cohen, Pontani, Lieberman & Pavane

(57) ABSTRACT

A device for internal mass balancing in self-reciprocating rolls, in which a balancing weight is arranged so as to permit a force ($F_a$) in the direction opposite to a reciprocating movement (A,B).

8 Claims, 3 Drawing Sheets

DEVICE FOR INTERNAL MASS BALANCING IN SELF-RECIPROCATING ROLLS

BACKGROUND OF THE INVENTION

1. Field of the Invention

The invention relates to a device for internal mass balancing in a self-reciprocating roll.

2. Description of the Related Art

DE 44 30 625 A1, to which U.S. Pat. No. 5,429,050 corresponds, discloses a gearbox configured for the transverse movement of a roll in a printing machine in such a way that a mechanism is provided which converts a relative rotational movement between the gearbox housing and an internal cylinder into an axial to-and-fro movement of the roll. The drawback with this configuration is that, as a result of this to-and-fro movement of the roll, forces are produced on account of the moving masses, and excite oscillations in the frame walls. It goes without saying that such an oscillation of the frame side walls is a hindrance to an optimum printing process.

SUMMARY OF THE INVENTION

The invention is based on the object of providing internal mass balancing in a self-reciprocating roll, a balancing weight being arranged in such a way that forces arising from the reciprocating movement and causing frame oscillations are eliminated by means of this balancing weight.

According to the invention, the object is achieved by a balancing weight arranged in the self-reciprocating roll to provide a force in a direction opposite to a roll reciprocating movement.

A significant advantage is that, as a result of the balancing weight, a force is generated which opposes the to-and-fro movement of the roll, eliminates the frame oscillations caused by this reciprocating movement and thus optimizes the printing process.

It is important that the entire device for internal mass balancing is fitted to a shaft of the roll. Such a constructional configuration of a device for internal mass balancing increases the multiplicity of the possible installations; thought should primarily be given to subsequent installation in self-reciprocating rolls already delivered to the customer.

If the balancing weight is mounted on the shaft of the roll, no drives for the balancing Weight are needed either, since the mass balancing is carried out with regard to a relative movement of the centres of gravity of the balancing weight and self-reciprocating roll.

A further variant of the device results from the balancing weight being assigned to the gearbox that executes a reciprocating movement of the roll. The preferred solution for internal mass balancing can be seen in this, since the balancing weight is moved in the direction opposite to the reciprocating movement of the roll, by means of a separate drive mechanism, which, as a significant advantage, still further increases the accuracy of the mass balancing. The mass balancing is carried out here by means of an absolute movement with regard to the position of the centres of gravity of the balancing weight and reciprocating roll.

DETAILED DESCRIPTION OF THE PRESENTLY PREFERRED EMBODIMENTS

Figure 1:
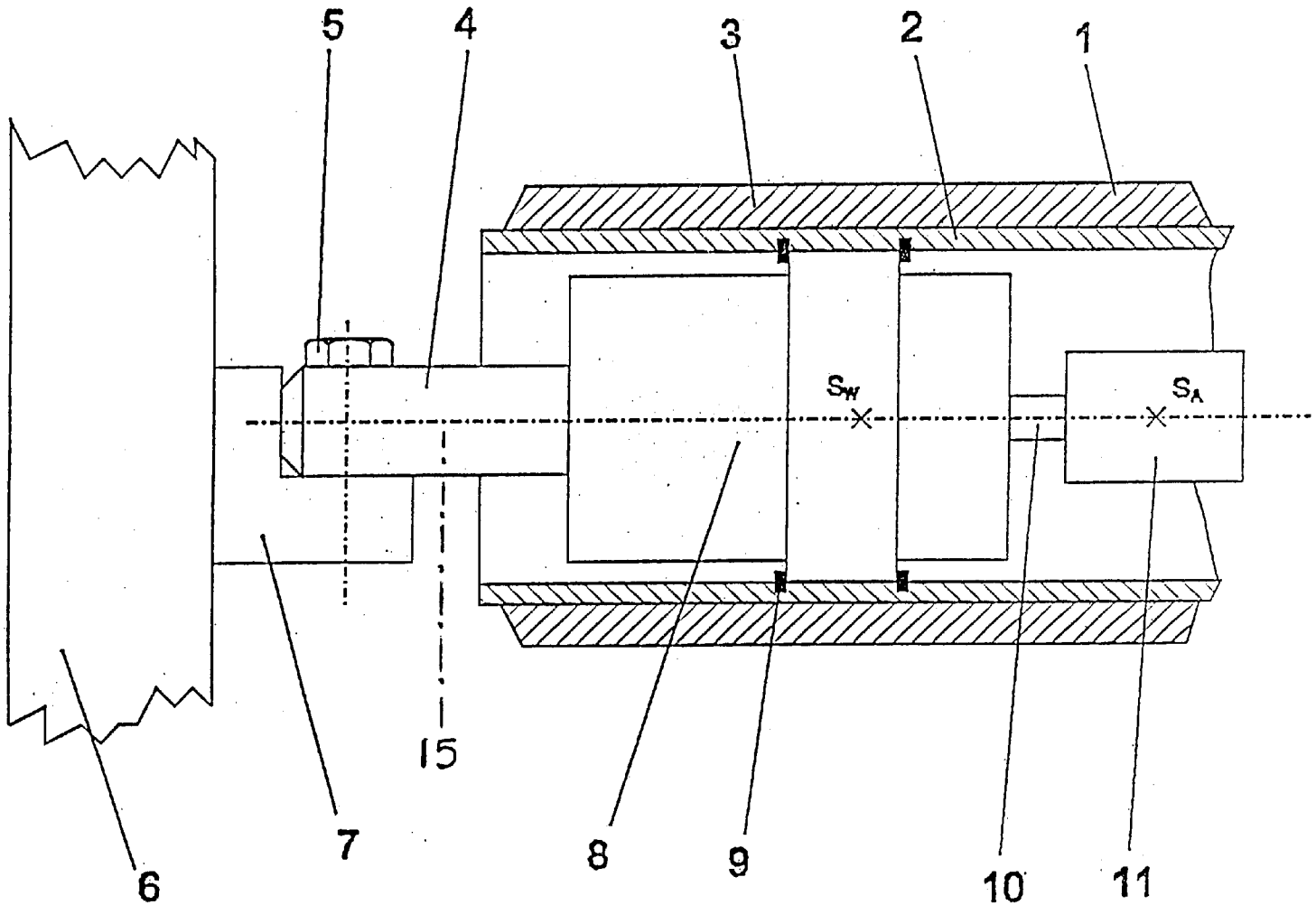
FIG. 1 shows a partial longitudinal section of a device for internal mass balancing in a self-reciprocating roll, which roll contains a gearbox for providing the reciprocating movement of the roll.

FIG. 1 illustrates a roll (1), which consists of a roll tube (2) which is made of steel, for example, its outer surface being coated with a roll cover (3), for example a rubber cover. In the interior of the roll tube (2), the roll (1) has a reciprocating gearbox (8), which is connected to the roll tube (2) by securing elements (9). The reciprocating gearbox (8) and the roll (1) are mounted on a common, stationary shaft (4). A balancing weight (11) is mounted on an extension (10) of this shaft (4). The shaft (4) is connected by fastening elements (5) to a roll lock (7) which is mounted on a frame wall (6). The entire roll (1) is mounted, in a manner not specifically illustrated, in a machine bed or machine frame, between mutually opposite frame walls (6). The rotation of the roll (1) is effected by contact (not illustrated) of its outer surface with one or more rolls which are mounted in the machine. For example, in the case of paper web offset printing machines, this rotation takes place at relatively high speeds, for example of about 2000 rev./mim. or still higher speeds. It is characteristic of the roll (1) shown in FIG. 1 that as they rotate the roll tube (2) and the roll cover (3) fitted to it simultaneously execute an axial to-and-fro movement, referred to below as a reciprocating movement, in order uniformly to distribute an ink or printer's black layer, which is located on the roll cover (3), together with the other rolls. This reciprocating movement is made possible by means of the reciprocating gearbox (8), which converts the rotation of the roll (1) into a reciprocating movement (A,B).

During the reciprocating movement (A,B) of the roll (1), the mass of the roll (1) produces a force which acts on the frame wall (6) and excites the latter to oscillate. In order to eliminate this force $F_w$, the balancing weight (11) is fitted to the shaft (4) or to the shaft extension (10), in order to permit internal mass balancing. As shown in FIG. 1, the centers of gravity $S_w$ and $S_a$ of the roll (1) and balancing weight (11), respectively, are on the common axis (15) of shaft (4) and its extension (10).

Figure 2:
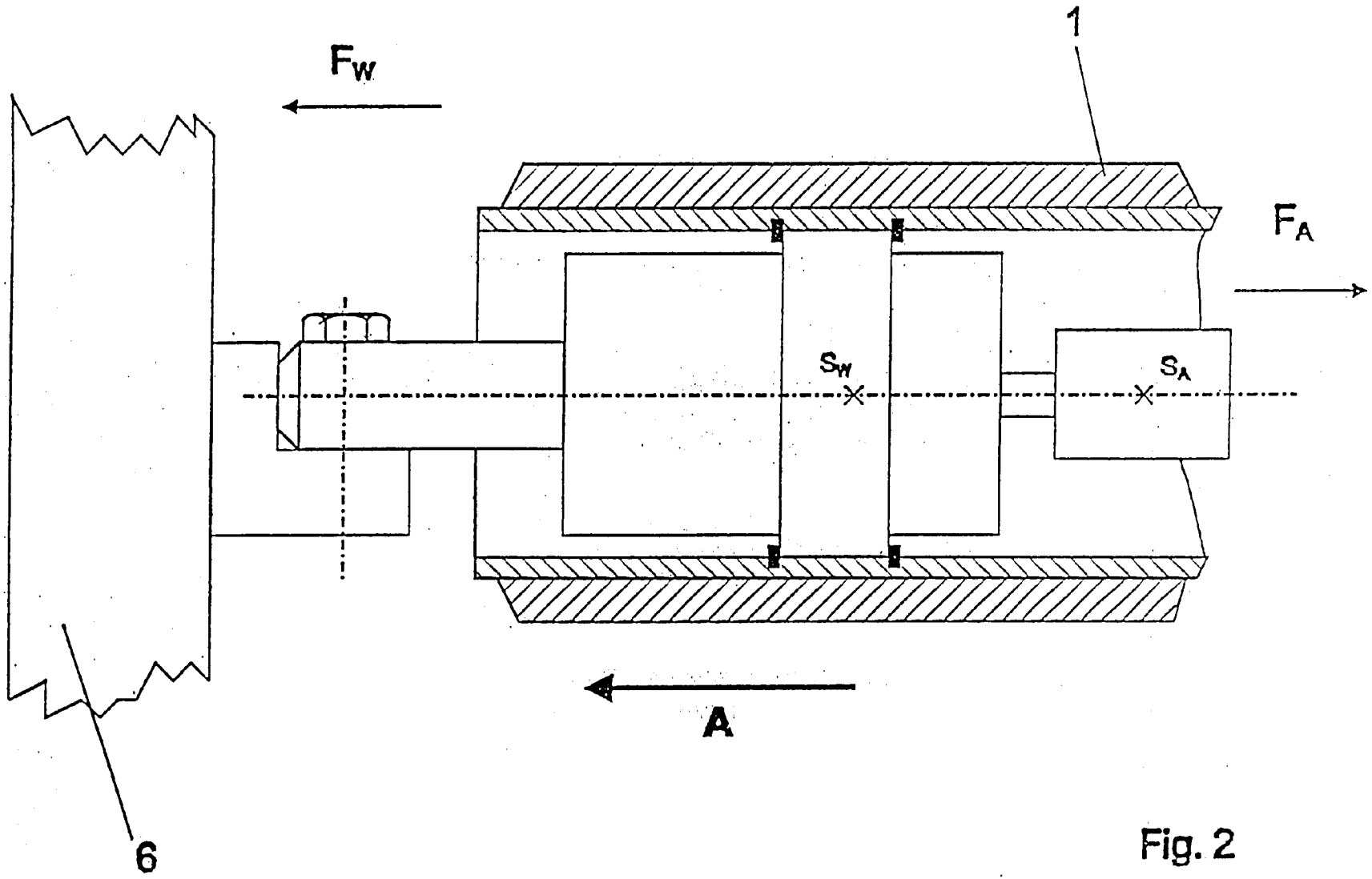
FIG. 2 is a view similar to FIG. 1, illustrating the reciprocating movement of the roll taking place in the direction of the frame wall.

FIG. 2 shows the reciprocating movement (A) of the roll (1) in the direction of the frame wall (6). On account of the moving mass of the roll (1), the reciprocating movement (A) results in the force $F_w$, and a pressure on the frame wall (6) is produced. A force $F_a$, brought about by the balancing weight (11), counteracts this force $F_w$ in a counter balancing direction to the direction of force $F_w$ with one arising from a relative movement, caused by the reciprocating movement (A), of roll (1) with regard to a positional change of the centres of gravity $S_w$ of the roll and that ($S_a$) of the balancing weight. The magnitudes of the forces $F_w$ and $F_a$ are identical but directed in opposite directions in each case, so that a force equilibrium is established. The frame wall (6) is thus no longer excited to oscillate.

Figure 3:
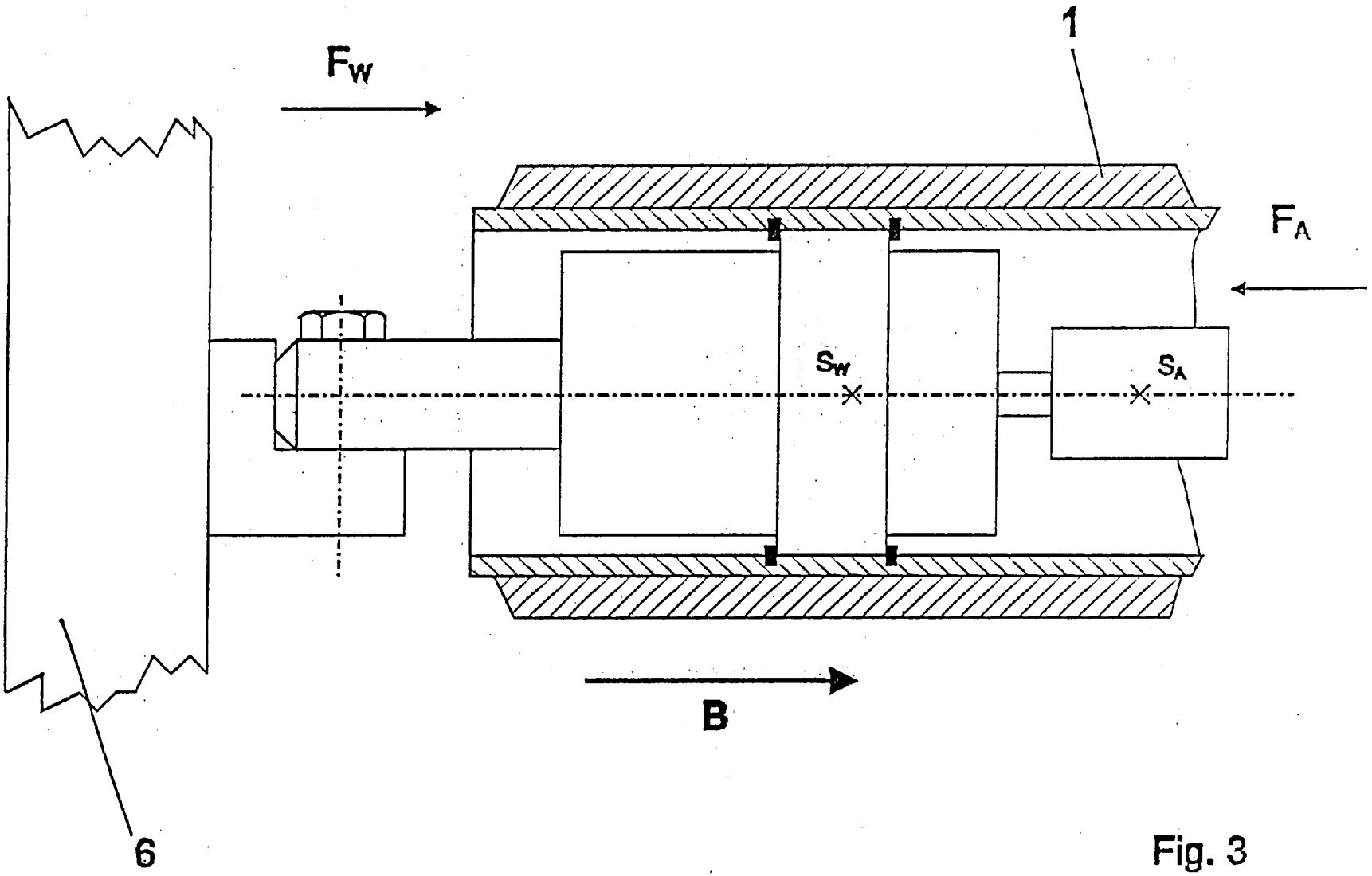
FIG. 3 is a view similar to FIG. 1, illustrating the reciprocating movement of the roll taking place away from the frame wall.

FIG. 3 shows the reciprocating movement (B) of the roll (1) away from the frame wall (6). As a result of this reciprocating movement (B), the force $F_w$ results once again, but a pull on the frame wall (6) is produced, since the reciprocating movement (B) is carried out in the direction opposite to that described in FIG. 2. The force $F_a$ brought about by the balancing weight (11) counteracts this force $F_w$ in accordance with the knowledge, already described in FIG. 2, of the relative movement with regard to the positional change of the centres of gravity $S_w$ and $S_a$. A force equilibrium is established, so that the frame wall (6) is no longer excited into oscillations.

A preferred variant of this device for internal mass balancing results from the relative movement with regard to the positional change of the centres of gravity $S_a$ and $S_w$ being replaced by an absolute movement. This absolute movement can be brought about by a mechanism which is preferably arranged in the reciprocating gearbox (8). This mechanism, preferably a mechanism similar to a gearbox, deflects the stationary or moving balancing weight (11) fixed to it in the direction opposite to the respective reciprocating movement (A,B), that is to say the change in position of the centres of gravity $S_a$ and $S_w$ is now carried out directly, that is to say by an absolute movement. As a result of the absolute movement of the balancing weight (11), the identical effects are achieved as in the relative movements described above, since the balancing weight (11) eliminates the force $F_w$ acting on the frame walls (6) as a result of the reciprocating movement (A,B) with the force $F_w$ resulting from the absolute movement with regard to the direct mutual positional change of the centres of gravity $S_a$ and $S_w$.

Finally, it should again be emphasized that the invention can be applied not only to those rolls (1), preferably self-reciprocating distributor rolls, such as are used in printing machines, but also to any other type of roll in which there is a requirement for the roll to be moved in the axial direction simultaneously during its rotation.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. An apparatus for internal mass balancing of a self-reciprocating roll, said apparatus comprising:

a fixed shaft;

a roll mounted for reciprocating movement in two opposite directions relative to said fixed shaft, means for moving said roll in said two opposite directions relative to said fixed shaft, and a balancing weight arranged on said fixed shaft so that, when said roll is moved in one of said two directions, said balancing weight produces a force in the other of said two directions.

2. An apparatus as in claim 1 wherein said roll comprises a roll tube which is rotatably mounted with respect to said shaft.

3. An apparatus as in claim 2 wherein said means for moving said roll comprises a reciprocating gearbox mounted inside said roll tube.

4. An apparatus as in claim 3 wherein said reciprocating gearbox is mounted on said fixed shaft.

5. An apparatus as in claim 2 wherein said balancing weight is arranged on said gearbox.

6. An apparatus as in claim 5 wherein said balancing weight is movable relative to said fixed shaft.

7. An apparatus 6 wherein said gearbox moves said balancing weight in a direction opposite to the movement of said roll.

8. An apparatus as in claim 1 wherein said means for moving said roll comprises a reciprocating gearbox mounted on said fixed shaft.

* * * * *